US009162445B2

(12) United States Patent
Miyasaka

(10) Patent No.: US 9,162,445 B2
(45) Date of Patent: Oct. 20, 2015

(54) LIQUID MATERIAL DISCHARGE CONTROL METHOD AND DROPLET DISCHARGE DEVICE

(75) Inventor: Yoichi Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 1398 days.

(21) Appl. No.: 12/173,332

(22) Filed: Jul. 15, 2008

(65) Prior Publication Data

US 2009/0040253 A1 Feb. 12, 2009

(30) Foreign Application Priority Data

Aug. 9, 2007 (JP) ..... 2007-207517

(51) Int. Cl.

*B05D 5/12* (2006.01)
*B41J 2/045* (2006.01)
*B41J 19/20* (2006.01)

(52) U.S. Cl.

CPC ..... *B41J 2/04581* (2013.01); *B41J 2/0456* (2013.01); *B41J 2/0458* (2013.01); *B41J 2/04573* (2013.01); *B41J 2/04578* (2013.01); *B41J 19/202* (2013.01); *B41J 2202/20* (2013.01)

(58) Field of Classification Search

USPC ..... 347/1, 5, 10, 11
See application file for complete search history.

(56) References Cited

U.S. PATENT DOCUMENTS

| | | | | |
|---|---|---|---|---|
| 5,561,449 | A * | 10/1996 | Raskin et al. | 347/37 |
| 5,815,172 | A * | 9/1998 | Moh | 347/14 |
| 2006/0087524 | A1 * | 4/2006 | Miller | 347/11 |
| 2006/0209105 | A1 * | 9/2006 | Huang et al. | 347/9 |
| 2007/0042113 | A1 * | 2/2007 | Ji et al. | 427/162 |

FOREIGN PATENT DOCUMENTS

| | | | |
|---|---|---|---|
| JP | H05-124289 | A | 5/1993 |
| JP | 2001-301163 | A | 10/2001 |
| JP | 2004-114305 | A | 4/2004 |
| JP | 2005-246123 | A | 9/2005 |

* cited by examiner

*Primary Examiner* — Austin Murata
(74) *Attorney, Agent, or Firm* — Global IP Counselors, LLP

(57) ABSTRACT

In a liquid material discharge control method, timing signals generated periodically are used to control discharge timing for discharging a liquid material from a plurality of nozzles onto a workpiece during a scan in which the nozzles and the workpiece are moved relative to each other. The liquid material discharge control method includes calculating a first elapsed time in a relative movement between the nozzles and the workpiece by counting a first prescribed number of outputs of the timing signals that define the discharge timing, comparing the first elapsed time with a first predicted time at which the nozzles are predicted to reach intended discharge positions on the workpiece, and discharging the liquid material from the nozzles onto the workpiece upon the first predicted time having elapsed when the first elapsed time is at least shorter than the first predicted time.

7 Claims, 12 Drawing Sheets

LIQUID MATERIAL DISCHARGE CONTROL METHOD AND DROPLET DISCHARGE DEVICE

CROSS-REFERENCE TO RELATED APPLICATIONS

This application claims priority to Japanese Patent Application No. 2007-207517 filed on Aug. 9, 2007. The entire disclosure of Japanese Patent Application No. 2007-207517 is hereby incorporated herein by reference.

BACKGROUND

1. Technical Field

The present invention relates to a liquid material discharge control method, and to a droplet discharge device.

2. Related Art

A known example of a liquid material discharge control method is an inkjet recording apparatus in which an encoder is provided to a carriage for supporting an inkjet head, the fundamental period of a drive pulse formed by the encoder pulse is lengthened, and channel interference between adjacent periods is eliminated (see Japanese Laid-Open Patent Application No. 2001-301163). According to this inkjet recording apparatus, it is possible to prevent loss of image quality that results in cases of correcting image disturbances caused by the carriage jittering (fluctuation).

A known example of using such an encoder pulse in discharge control is a recording apparatus in which speed detection means detects the actual speed of the carriage on the basis of an output signal from the encoder, and when the time period during which the actual speed exceeds the allowable range of the designated speed continues for a specific amount of time or longer, it is assumed that the carriage is operating abnormally, and an error process is performed (see Japanese Laid-Open Patent Application No. 5-124289).

Furthermore, in another known inkjet recording apparatus, in cases in which the width of drive waveforms for driving the drive elements provided to each nozzle of the inkjet head is smaller than the period of the encoder signal, the output of new image data to the drive elements is ceased (see Japanese Laid-Open Patent Application No. 2004-114305).

SUMMARY

However, the inkjet recording apparatus of Patent Document 1 has problems in that since variation brought about by the carriage jittering is added to the fundamental period of the drive pulse, the substantial drive period is lengthened, and high-speed printing is difficult to achieve.

The recording apparatus in Japanese Laid-Open Patent Application No. 5-124289 and the inkjet recording apparatus in Japanese Laid-Open Patent Application No. 2004-114305 have problems in that the error (abnormality) process may occur frequently when the movement speed of the carriage is increased in an attempt to increase the speed of printing.

The present invention was devised in order to resolve at least some of the problems described above, and can be actualized as the following aspects or application examples.

In a liquid material discharge control method according to a first example of the present invention, timing signals generated periodically are used to control discharge timing for discharging a liquid material from a plurality of nozzles onto a workpiece during a scan in which the nozzles and the workpiece are moved relative to each other. The liquid material discharge control method includes calculating a first elapsed time in a relative movement between the nozzles and the workpiece by counting a first prescribed number of outputs of the timing signals that define the discharge timing, comparing the first elapsed time with a first predicted time at which the nozzles are predicted to reach intended discharge positions on the workpiece, and discharging the liquid material from the nozzles onto the workpiece upon the first predicted time having elapsed when the first elapsed time is at least shorter than the first predicted time.

According to this method, the liquid material is discharged from the nozzles when the first predicted time has elapsed, even if fluctuation occurs in the timing signals and the first elapsed time is shorter than the first predicted time. Therefore, the liquid material can be prevented from being discharged at a sooner timing than the target discharge timing. Specifically, it is possible to control the discharge timing by means of the timing signals and the first predicted time, and the effects of the time signal fluctuation on the discharge timing can be reduced.

The liquid material discharge control method as mentioned above may further includes calculating a second elapsed time by counting a second prescribed number of outputs of the timing signals with the second prescribed number being obtained by subtracting a predetermined number from the first prescribed number, comparing the second elapsed time with a second predicted time with the second predicted time being obtained by subtracting a predetermined time corresponding to the predetermined number from the first predicted time, and discharging the liquid material from the nozzles onto the workpiece upon the first predicted time having elapsed when the second elapsed time is shorter than the second predicted time or longer than the second predicted time.

According to this method, in cases in which fluctuation occurs in the timing signals and the actual discharge timing is predicted to be early or delayed, the liquid material is discharged from the nozzles when the first predicted time has passed. Therefore, liquid material can be discharged stably onto the intended discharge positions.

In the liquid material discharge control method as mentioned above, the discharging of the liquid material may include applying at least one periodically generated drive waveform to a drive unit of the nozzles to discharge the liquid material as droplets from the nozzles, and selectively applying a subsequently generated drive waveform to the drive unit after output of a previously generated drive waveform has ended when the first elapsed time is shorter than the first predicted time or when the second elapsed time is shorter than the second predicted time.

According to this method, in cases in which fluctuation occurs in the timing signals and the actual discharge timing is predicted to be early, the next drive waveform is not applied to the drive unit during the application of the previous drive waveform. Therefore, drive waveforms can be reliably applied to the drive unit, and the liquid material can be discharged in stable amounts.

The liquid material discharge control method as mentioned above may further includes resynchronizing a subsequent discharge timing with the timing signal within a prescribed time period in which the droplets are not discharged from all of the nozzles during the scan.

According to this method, control in which the discharge timings are based on timing signals is reinstated, rather than control in which the discharge timings are all based on predicted times. Therefore, it is possible to prevent instances in which a vast amount of data defining the discharge timings arises as time passes. Specifically, the discharge timing can be controlled efficiently.

In the liquid material discharge control method as mentioned above, the resynchronizing of the subsequent discharge timing may include correcting a number of outputs of the timing signals counted in the prescribed time period in which the droplets are not discharged from all of the nozzles so as to coincide with a time period until a next intended discharge position.

According to this method, the liquid material can be discharged to the intended discharge position in the next discharge timing even if fluctuation occurs in the timing signal.

In the liquid material discharge control method as mentioned above, the calculating of the first elapsed time, the comparing of the first elapsed time with the first predicted time, the discharging of the liquid material and the resynchronizing of the subsequent discharge timing may be performed by dividing the relative movement during the scan into forward movement and reverse movement.

The manner in which the timing signal fluctuates is not necessarily the same in both the forward and backward movement of the relative movement. According to this method, the liquid material can be stably discharged onto the intended discharge positions during the forward movement and backward movement of the relative movement.

In the liquid material discharge control method as mentioned above, the workpiece may have a plurality of film formation areas arrayed in a scanning direction, and the calculating of the first elapsed time, the comparing of the first elapsed time with the first predicted time, the discharging of the liquid material and the resynchronizing of the subsequent discharge timing may be performed for each film formation area.

According to this method, the liquid material can be discharged stably onto the intended discharge positions in each of the film formation areas in the scanning direction.

In the liquid material discharge control method as mentioned above, the discharging of the liquid material may include discharging a plurality of droplets from the nozzles onto each film formation area on the workpiece during the scan. The calculating of the first elapsed time, the comparing of the first elapsed time with the first predicted time and the discharging of the liquid material may be performed at an initial discharge of the droplets on each film formation area, and the drive waveform may be continued to be applied to the drive unit to discharge the droplets from the nozzles.

According to this method, in cases in which droplets are continuously discharged onto each of the film formation areas, the drive waveforms are reliably applied to the drive unit in a specific time period based on the first predicted time, and the liquid material can therefore be discharged in stable amounts onto the intended discharge positions in each of the film formation areas in the scanning direction.

In the liquid material discharge control method as mentioned above, the discharging of the liquid material may include discharging a plurality of droplets from the nozzles onto each film formation area on the workpiece during the scan, and discharging first droplets onto each of the film formation areas by counting a prescribed number of outputs of the timing signals that define the discharge timing, and the calculating of the first elapsed time, the comparing of the first elapsed time with the first predicted time and the discharging of the liquid material may be performed when discharging second droplets onto each film formation area, and the drive waveform may be continued to be applied to the drive unit when the droplets continue to be discharged.

The arrangement of film formation areas on the workpiece does not need to be set using units of discharge resolution based on the relative movement speed in a scan. Therefore, to ensure stable initial discharge positions in the film formation areas, it is preferable that discharge be initiated based on the timing signals generated along with the scan. According to this method, the first discharge for each film formation area is performed by counting the specific number of timing signal outputs. Therefore, a plurality of droplets can be sequentially discharged in stable discharge amounts onto each film formation area, beginning with a specific initial discharge position.

In a droplet discharge device according to one example of the present invention, drive waveforms are applied to a drive unit of a plurality of nozzles during a scan in which a workpiece and a droplet discharge head having the nozzles are moved relative to each other to discharge a liquid material as droplets from the nozzles onto the workpiece. The droplet discharge device includes a timing signal generation unit, a calculation unit, a comparison unit, a drive waveform generation unit and a head drive unit. The timing signal generation unit is configured to periodically generate timing signals along with the scan. The calculation unit is configured to calculate an elapsed time during the relative movement by counting a prescribed number of outputs of the timing signals that define a discharge timing of the droplets. The comparison unit is configured to compare the elapsed time with a predicted time at which the nozzles are predicted to reach intended discharge positions on the workpiece. The drive waveform generation unit is configured to periodically generate the drive waveform. The head drive unit is configured to apply at least one of the periodically generated drive waveforms to the drive unit, the head drive unit being further configured to apply the drive waveform to the drive unit upon the predicted time having elapsed when the elapsed time is at least shorter than the predicted time.

According to this configuration, even if fluctuation occurs in the timing signals generated by the timing signal generation unit, the predicted time and elapsed time reflecting this fluctuation can be compared to control the discharge timing, and droplets can be discharged onto the intended discharge positions. Specifically, it is possible to provide a droplet discharge device for stably discharging droplets on the basis of the timing signals and the predicted time.

In the droplet discharge device as mentioned above, the head drive unit may be further configured to selectively apply a subsequently generated drive waveform to the drive unit after an output of a previously generated drive waveform has ended when the elapsed time is shorter than the predicted time.

It is thereby possible to provide a droplet discharge device capable of discharging a liquid material as droplets in stable discharge amounts, because the drive waveforms are reliably applied to the drive unit.

The droplet discharge device as mentioned above, the head drive unit may be further configured to apply the drive waveform to the drive unit to discharge the droplets from the nozzles during an initial droplet discharge upon the predicted time having elapsed when the elapsed time is at least shorter than the predicted time, and to continue to selectively apply a next drive waveform to the drive unit as the head drive unit continuously discharges in the scanning direction.

The liquid material can thereby be continuously discharged as droplets in stable discharge amounts.

In the droplet discharge device as mentioned above, the head drive unit may be further configured to apply the drive waveform to the drive unit to discharge initial droplets from the nozzles by counting a prescribed number of timing signals that define the droplet discharge timing, to apply the drive waveform to the drive unit to discharge second droplets from the nozzles upon the predicted time having elapsed when the elapsed time is at least shorter than the predicted time, and to selectively apply the next drive waveform to the drive unit when the droplets are discharged continuously in the scanning direction.

Stable initial discharge positions based on the timing signals can thereby be ensured by counting the specific number of timing signals that define the discharge timing and discharging the droplets. In cases in which the droplets continue to be discharged, the drive waveforms can be reliably applied to the drive unit, and the droplets can be continuously discharged in stable discharge amounts.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
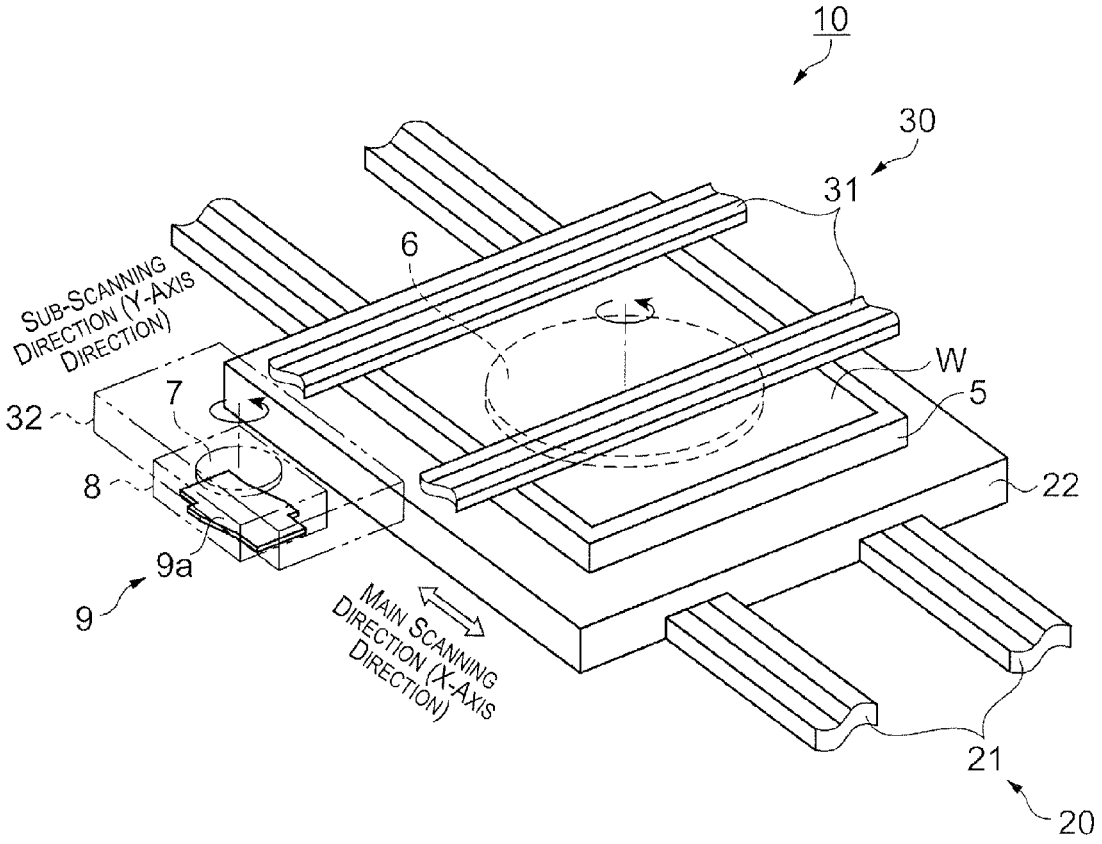
FIG. 1 is a schematic perspective view showing the configuration of the droplet discharge device.

Embodiments of the present invention are described hereinbelow with reference to the drawings. In the drawings pertaining to the following descriptions, the parts are appropriately varied in scale in order to be displayed at a size that will make these parts recognizable.

First Embodiment

Droplet Discharge Device

First, the configuration of the droplet discharge device according to the present embodiment will be described with reference to FIGS. 1 through 6. FIG. 1 is a schematic perspective view showing the configuration of the droplet discharge device.

The droplet discharge device 10 of the present embodiment comprises a workpiece-moving mechanism 20 for moving a workpiece W in the main scanning direction (X-axis direction), and a head-moving mechanism 30 for moving a head unit 9 in the sub-scanning direction (Y-axis direction), as shown in FIG. 1.

The workpiece-moving mechanism 20 comprises a pair of guide rails 21, a moving base 22 that moves along the pair of guide rails 21, and a stage 5 for carrying a workpiece W placed via a rotating mechanism 6 on the moving base 22. The moving base 22 is moved in the main scanning direction by air sliders and linear motors (not shown) provided to the guide rails 21. The moving base 22 is provided with an encoder 12 (see FIG. 4) as a timing signal generator. As the moving base 22 moves relative to the encoder 12 in the main scanning direction, the encoder 12 reads gradations in a linear scale (not shown) arranged in parallel to the guide rails 21, and generates an encoder pulse as a timing signal. The stage 5 is capable of fixedly chucking the workpiece W, and is also capable of correctly aligning a reference axis in the workpiece W with the main scanning direction and sub-scanning direction by means of the rotating mechanism 6. The placement of the encoder 12 is not limited to this option alone, and in cases in which, e.g., the moving base 22 is configured so as to move in relative fashion in the X-axis direction along a rotating shaft and in which a drive unit for rotating the rotating shaft is provided, the encoder 12 may be provided to the drive unit. A servomotor or the like is a possible example of the drive unit.

The head-moving mechanism 30 comprises a pair of guide rails 31, and a moving base 32 that moves along the pair of guide rails 31. The moving base 32 is provided with a carriage 8 that is hung via a rotating mechanism 7. Attached to the carriage 8 is a head unit 9 on which a plurality of droplet discharge heads 50 (see FIG. 2) is mounted. Also provided are a liquid material supply mechanism (not shown) for supplying liquid material to the droplet discharge heads 50, and a head driver 48 (see FIG. 4) for controlling the electrical drive of the plurality of droplet discharge heads 50. The moving base 32 moves the carriage 8 in the Y-axis direction and disposes the head unit 9 to face the workpiece W.

In addition to the configuration described above, the droplet discharge device 10 has a maintenance mechanism for unclogging the nozzles of the plurality of droplet discharge heads 50 mounted on the head unit 9, removing impurities and dirt from the nozzle surfaces, and performing other such maintenance. The maintenance mechanism is placed at a position facing the plurality of droplet discharge heads 50. Also provided is a weight measurement mechanism having an electronic scale or another such measurement device for receiving the liquid material discharged from each droplet discharge head 50 and measuring the weight thereof. The maintenance mechanism and the weight measurement mechanism are not shown in FIG. 1.

Figure 2:
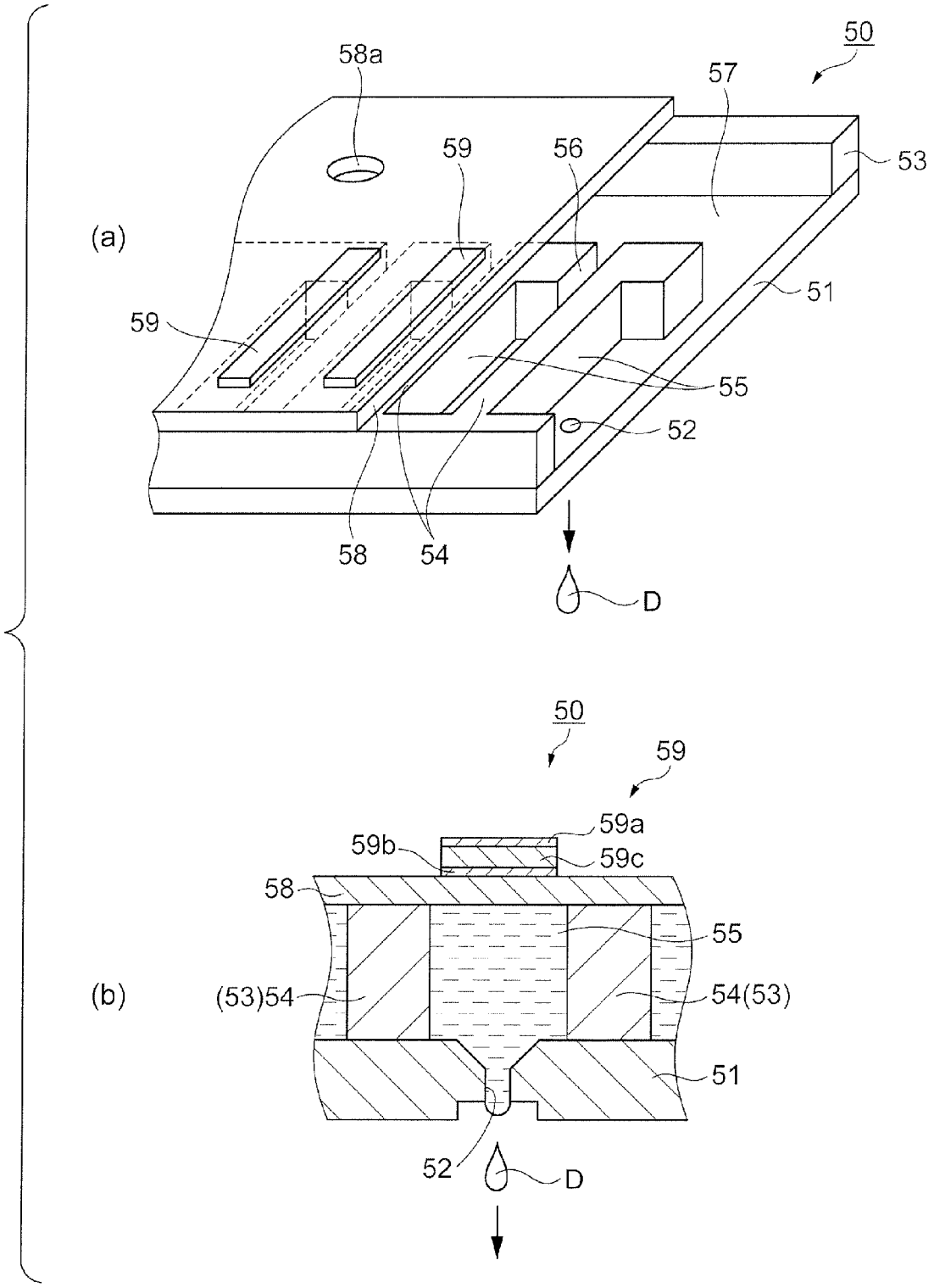
FIG. 2(*a*) is a schematic exploded perspective view showing the structure of a droplet discharge head, and (*b*) is a cross-sectional view showing the structure of a nozzle unit.

FIG. 2 is a schematic view showing the structure of a droplet discharge head. FIG. 2(*a*) is a schematic exploded perspective view, and FIG. 2(*b*) is a cross-sectional view showing the structure of a nozzle unit. A droplet discharge head 50 has a structure in which a nozzle plate 51 having a plurality of nozzles 52, a cavity plate 53 having walls 54 for partitioning cavities 55 communicated with the plurality of nozzles 52, and a oscillating plate 58 having oscillators 59 as drive unit corresponding to the cavities 55 are stacked and bonded together in the stated order, as shown in FIGS. 2(*a*) and 2(*b*).

The cavity plate 53 has walls 54 for partitioning the cavities 55 communicated with the nozzles 52, and flow channels 56, 57 for filling the cavities 55 with liquid material. The flow channel 57 is enclosed by the nozzle plate 51 and the oscillating plate 58, and the space thus formed fulfills the role of a reservoir in which liquid material is collected.

The liquid material is supplied from a liquid material supply mechanism through a pipe, and after being collected in the reservoir through a supply port 58*a* provided in the oscillating plate 58, the liquid material is filled into the cavities 55 through the flow channels 56.

Each oscillator 59 is a piezoelectric element composed of a piezoelement 59*c*, and a pair of electrodes 59*a*, 59*b* sandwiching the piezoelement 59*c*, as shown in FIG. 2(*b*). The bonded oscillating plate 58 is deformed by the application of a drive waveform to the pair of electrodes 59*a*, 59*b* from an external source. The cavity 55 partitioned by the walls 54 thereby increases in volume, and the liquid material is drawn into the cavity 55 from the reservoir. When the application of the drive waveform ends, the oscillating plate 58 returns to its original state, and pressure is applied to the filled liquid material. A structure is thereby created that can discharge liquid material as droplets D from the nozzle 52. By controlling the drive waveforms applied to the piezoelements 59*c*, discharge of the liquid material can be controlled for each of the nozzles 52.

The drive unit in the droplet discharge heads 50 are not limited to piezoelectric elements. Other possibilities include electro-mechanical conversion elements for displacing the oscillating plates 58 by electrostatic chucking, and electro-thermal conversion elements (a thermal system) for heating the liquid material to discharge the liquid material as droplets D from the nozzles 52.

Figure 3:
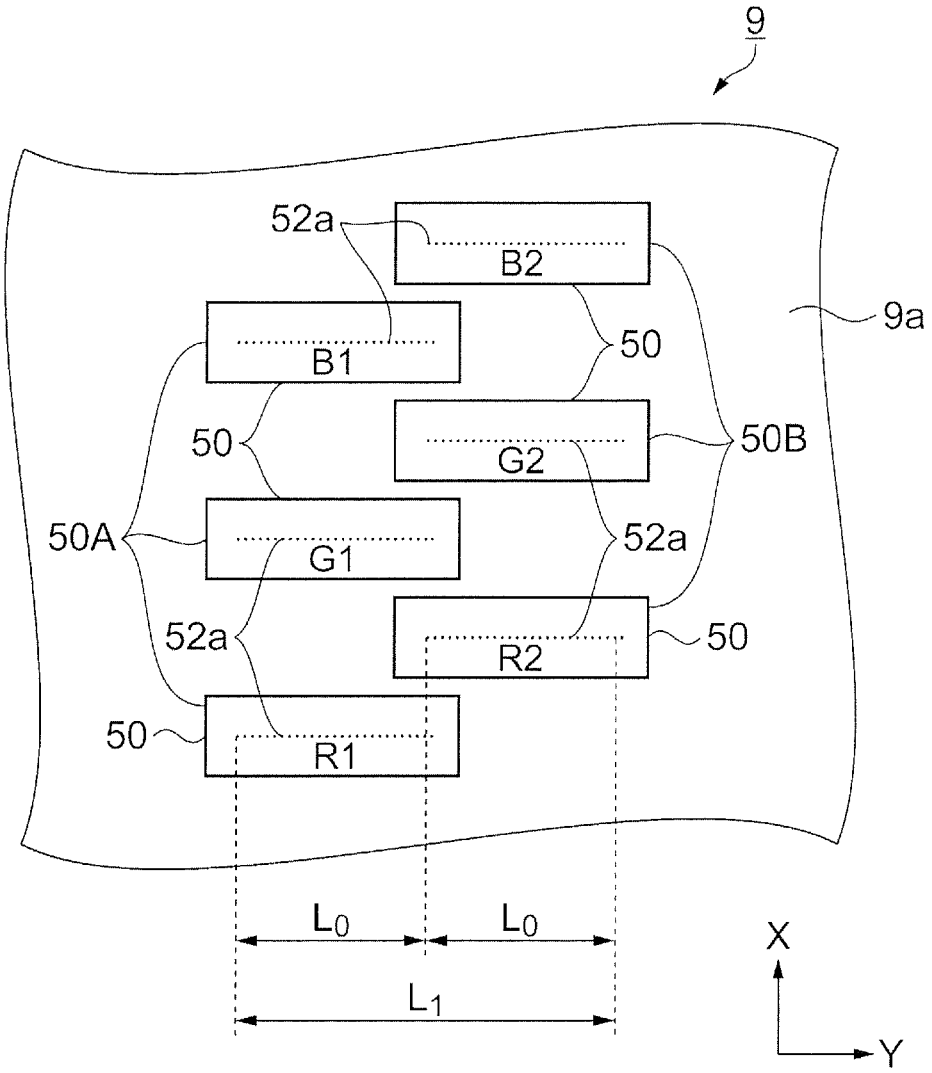
FIG. 3 is a schematic plan view showing the arrangement of droplet discharge heads in a head unit.

FIG. 3 is a schematic plan view showing the arrangement of droplet discharge heads in the head unit. Specifically, this is a view as seen from the side facing the workpiece W.

The head unit 9 comprises a head plate 9*a* on which the plurality of droplet discharge heads 50 is placed, as shown in FIG. 3. Mounted on the head plate 9*a* are a head group 50A composed of three droplet discharge heads 50, and a head group 50B similarly composed of three droplet discharge heads 50, for a total of six droplet discharge heads 50. In this case, the head R1 (droplet discharge head 50) of the head group 50A and the head R2 (droplet discharge head 50) of the head group 50B discharge the same liquid material. The same applies to the other heads G1 and G2, and the heads B1 and B2. Specifically, the configuration is designed to be capable of discharging three different liquid materials.

The droplet discharge heads 50 have nozzle rows 52*a* composed of a plurality of (180) nozzles 52 arranged at substantially equal intervals (a nozzle pitch of approximately 140 μm). The nozzles 52 have a diameter of approximately 28 μm. The imaging width that can be imaged by one droplet discharge head 50 is $L_0$, which is the effective length of a nozzle row 52*a*. The term "nozzle row 52*a*" hereinafter refers to a configuration of 180 nozzles 52.

In this case, the head R1 and the head R2 are arranged in parallel to the main scanning direction so that nozzle rows 52*a* that are adjacent as seen from the main scanning direction (X-axis direction) are separated by one nozzle pitch in the sub-scanning direction (Y-axis direction), which is orthogonal to the main scanning direction. Therefore, the effective imaging width $L_1$ of the head R1 and the head R2 for discharging the same liquid material is twice the imaging width $L_0$. The heads G1 and G2 and the heads B1 and B2 are similarly disposed in parallel to the main scanning direction.

The number of nozzle rows 52*a* provided to each droplet discharge head 50 is not limited to one. For example, if a plurality of nozzle rows 52*a* is arranged out of alignment from each other, the substantial nozzle pitch narrows, and droplets D can be discharged in high definition.

Figure 4:
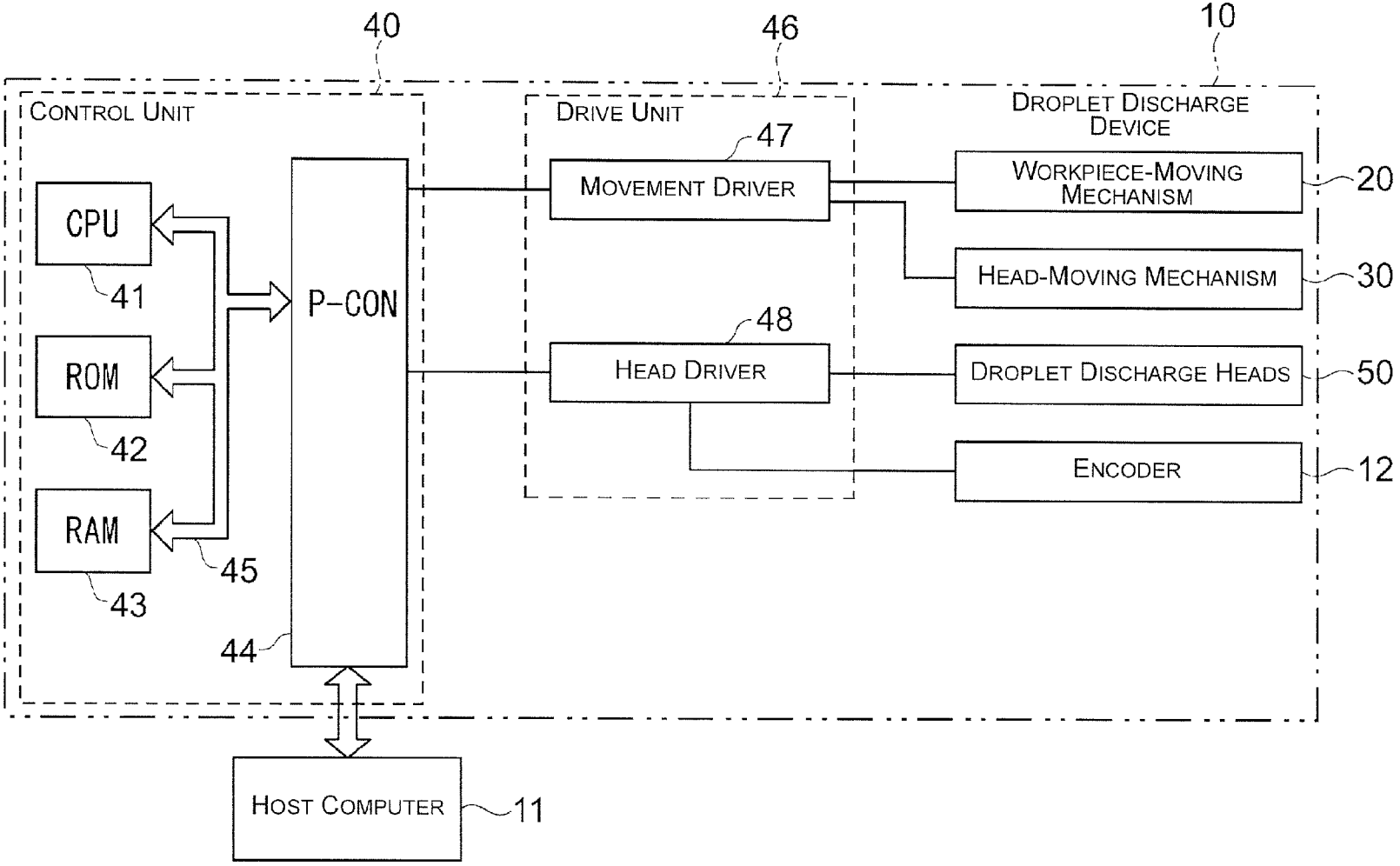
FIG. 4 is a block diagram showing the control system of the droplet discharge device.

Next, the control system of the droplet discharge device 10 will be described. FIG. 4 is a block diagram showing the control system of the droplet discharge device. The control system of the droplet discharge device 10 comprises a drive unit 46 having various drivers for driving the droplet discharge heads 50, the workpiece-moving mechanism 20, the head-moving mechanism 30, and other components, and further comprises a control unit 40 for controlling the droplet discharge device 10, wherein the control unit 40 includes the drive unit 46, as shown in FIG. 4.

The drive unit 46 comprises a movement driver 47 for drivably controlling the linear motors of the workpiece-moving mechanism 20 and the head-moving mechanism 30, and a head driver 48 as a drive unit for controlling the discharge of the droplet discharge heads 50. A weight measurement driver and a maintenance driver are also included, but are not shown in the diagram.

The control unit 40 comprises a CPU 41, a ROM 42, a RAM 43, and a P-CON 44, which are connected to each other via a bus 45. A host computer 11 is connected to the P-CON 44. The ROM 42 has a control program area for storing control programs and the like executed in the CPU 41, and a control data area for storing control data and the like for performing imaging operations, function recovery processes, and the like.

The RAM 43 has an imaging data storage unit for storing imaging data used to create images on the workpiece W, a position data storage unit for storing position data of the workpiece W and droplet discharge heads 50 (in practice, nozzle rows 52*a*), and various other storage units, and is used as operating areas for control processes. Various drivers and the like of the drive unit 46 are connected to the P-CON 44, and logic circuits for supplementing the function of the CPU 41 and for handling interface signals with the surrounding circuits are configured and incorporated into the P-CON 44. Therefore, the P-CON 44 incorporates various commands and the like from the host computer 11 into the bus 45 either without processing the commands or after processing them, and also presents the drive unit 46 with data or control signals outputted from the CPU 41 and the like to the bus 45 either without processing the data or control signals or after processing them, in conjunction with the CPU 41.

The CPU 41 inputs various detection signals, commands, data, and the like via the P-CON 44 in accordance with the control programs in the ROM 42, processes the various data in the RAM 43, and then outputs various control signals to the drive unit 46 and the like via the P-CON 44, thereby controlling the entire droplet discharge device 10. For example, the CPU 41 controls the droplet discharge heads 50, the workpiece-moving mechanism 20, and the head-moving mechanism 30, and places the head unit 9 and the workpiece W so that they face each other. Control signals are sent to the head driver 48 in synchronization with the relative movement of the head unit 9 and workpiece W so that liquid material is discharged as droplets D onto the workpiece W from the plurality of nozzles 52 of the droplet discharge heads 50 mounted on the head unit 9. In this case, the discharge of liquid material in synchronization with the movement of the workpiece W in the X-axis direction is referred to as main scanning, and the movement of the head unit 9 in the Y-axis direction is referred to as sub-scanning. The droplet discharge device 10 of the present embodiment can discharge liquid material to create images by combining main scanning and sub-scanning and performing multiple scans. Main scanning is not limited to the movement of the workpiece W in one direction relative to the droplet discharge heads 50, and can also be a reciprocating movement of the workpiece W.

The encoder 12 is electrically connected to the head driver 48, and generates an encoder pulse along with main scanning. During main scanning, the moving base 22 is moved at a specific movement speed, and an encoder pulse is therefore generated periodically.

The host computer 11 sends control programs, control data, and other such control information to the droplet discharge device 10. The host computer 11 also has the function of a arrangement information generator for generating arrangement information as discharge control data for arranging the necessary amount of liquid material as droplets D in each film formation area on a substrate. The arrangement information uses a bitmap, for example, to express information such as the discharged positions of droplets D in the film formation areas (in other words, the relative positions of the workpiece W and nozzles 52), the number of droplets D arranged (in other words, the number of discharges of each nozzle 52), whether the plurality of nozzles 52 is on or off during main scanning, and the discharge timing. The host computer 11 not only creates the aforementioned arrangement information, but can also correct the aforementioned arrangement information temporarily stored in the RAM 43.

Figure 5:
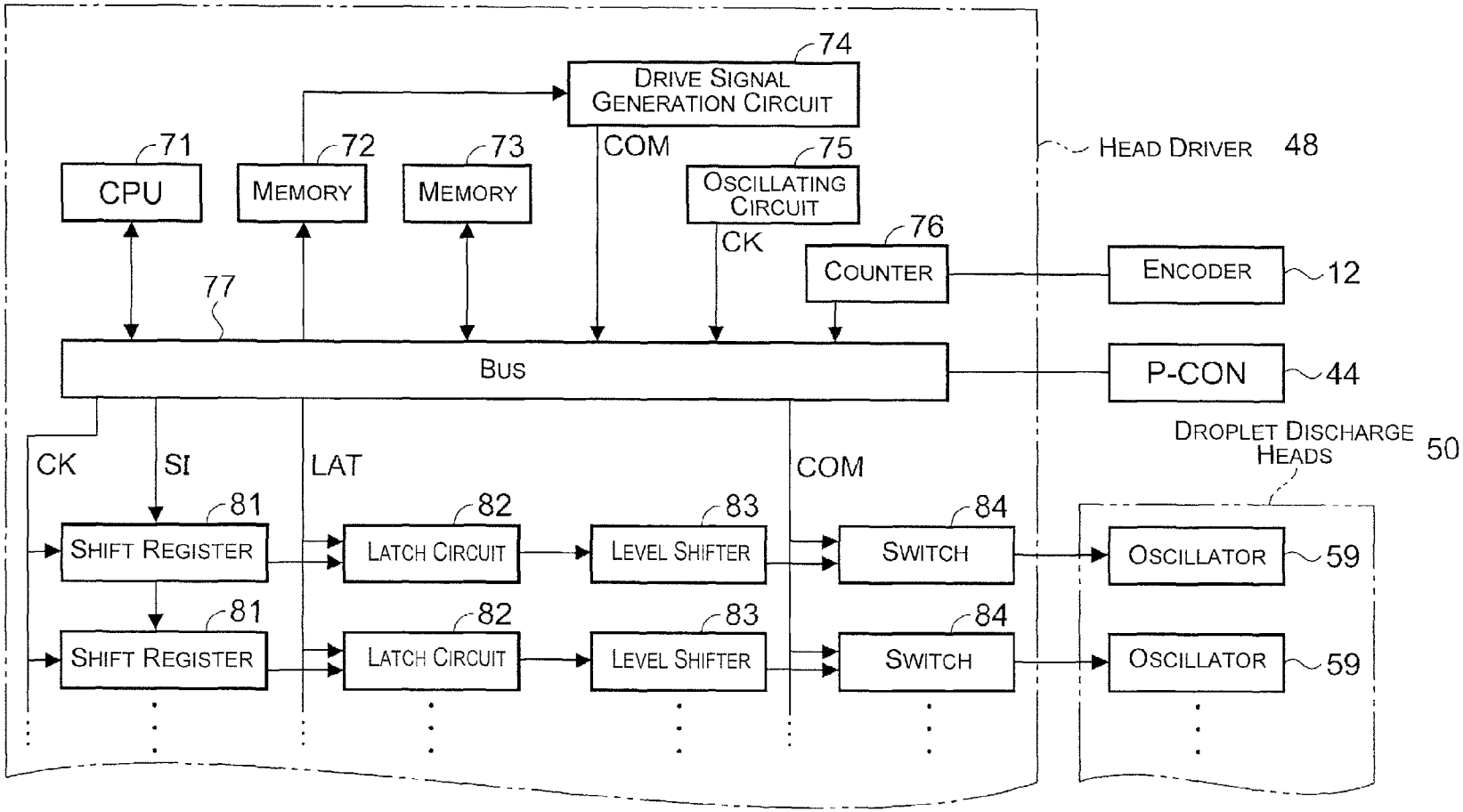
FIG. 5 is a block diagram showing the electrical configuration of the head driver.
Figure 6:
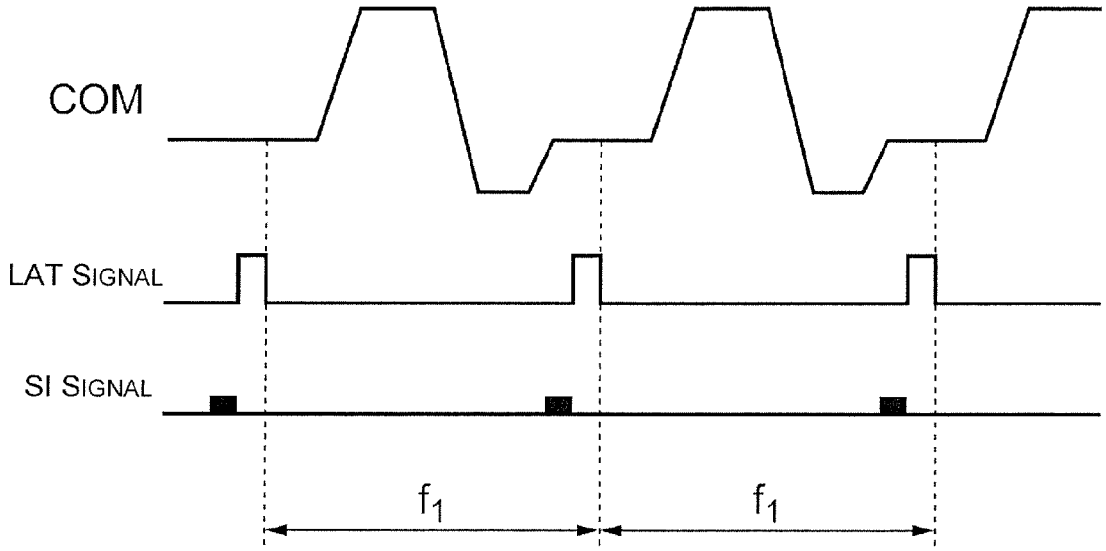
FIG. 6 is a diagram showing control signals in discharge control.

Next, the head driver will be described with reference to FIGS. 5 and 6. FIG. 5 is a block diagram showing the electrical configuration of the head driver, and FIG. 6 is a diagram showing the control signals for discharge control.

The head driver 48 as a head drive unit comprises a CPU 71, two memory units 72, 73, a drive signal generation circuit 74 as a drive waveform generator for generating drive waveforms (COM), an oscillating circuit 75 for generating clock signals (CK), and a counter 76 for counting encoder pulses, the counter being connected to the encoder 12. Also provided are shift registers 81, latch circuits 82, level shifters 83, and switches 84. These electrical configurations are connected via a bus 77. The configuration is thereby designed so that drive waveforms (COM) can be selectively applied to oscillators 59 corresponding to the nozzles 52 of the droplet discharge heads 50.

The CPU 71 generates drive waveforms as digital data and stores (places) the data in the memory 72. The drive signal generation circuit 74 converts this digital data to analog signals and generates drive waveforms applied to the oscillators 59. The memory 72 is SRAM, for example.

In the present embodiment, the oscillating circuit 75 uses a 20-MHz crystal oscillator as a reference clock to generate clock signals. The CPU 71 generates drive waveforms as digital data on the basis of the clock signals. Therefore, it is possible to set drive waveforms at increments of 0.05 μsec. Discharge timing control at 0.05 μsec increments, which is described hereinafter, is also possible.

The host computer 11 presents the head driver 48 with arrangement information as discharge control data for arranging the droplets D as dots on the workpiece W. The transmitted arrangement information is generated as separate forward and reverse movements during main scanning, and is temporarily stored (placed) in the memory 73. The memory 73 is SDRAM, for example.

The arrangement information includes the relative intended discharge positions of the plurality of nozzles 52 in relation to the workpiece W, the selection of nozzles 52 for discharging droplets D, the number of discharges of droplets D, and discharge timing information for use when the droplets D are discharged. The discharge timing information is presented in numerical form by correlating the number of outputs of encoder pulses, generated by the encoder 12 during main scanning, with the intended discharge positions. The CPU 71 then generates nozzle data signals (SI) and drive waveforms (COM) for each nozzle row unit in the following manner, on the basis of the discharge control data.

Specifically, the CPU 71 decodes the discharge control data and generates nozzle data that includes ON/OFF information for each of the nozzles 52. The drive signal generation circuit 74 sets and generates drive waveforms (COM) on the basis of the nozzle data calculated by the CPU 71.

The nozzle data signals (SI), which are nozzle data converted to serial signals, are transmitted to the shift register 81 in synchronization with the clock signals (CK), and ON/OFF information is individually stored for each of the nozzles 52. Latch signals (LAT) generated by the CPU 71 are inputted to the latch circuits 82 in synchronization with the encoder pulses counted by the counter 76, whereby the nozzle data is latched. The latched nozzle data is amplified by the level shifters 83, and specific voltages are supplied to the switches 84 when the nozzle data is "ON." When the nozzle data is "OFF," voltages are not supplied to the switches 84.

While the voltages increased by the level shifters 83 are being supplied to the switches 84, drive waveforms (COM) are applied to the oscillators 59, and droplets D are discharged from the nozzles 52 (see FIG. 2).

This type of discharge control is performed periodically as shown in FIG. 6, in synchronization with the relative movement of the head unit 9 and workpiece W (main scanning).

The drive waveforms (COM) are a combination of rectangular pulse signals amplified on both sides of a midpoint potential as shown in FIG. 6, and one droplet D is discharged by one drive waveform in the following manner.

Specifically, liquid material is drawn into the cavities 55 (see FIG. 2(*b*)) by increasing the electric potential level of the pulse signals. Next, a steep drop in the electric potential level causes the liquid material in the cavities 55 to suddenly increase in pressure, and the liquid material is pushed out through the nozzles 52 and formed into droplets (discharged). Lastly, the lowered electric potential level is returned to the midpoint potential, thereby counteracting the pressure vibrations (characteristic vibrations) in the cavities 55.

The voltage components, time components (slope of pulse signals, connecting intervals between pulse signals, and the like), and other such components of the drive waveforms (COM) are parameters that are highly relevant to the amount discharged, the discharge stability, and other such factors, and must be set appropriately in advance. In the present embodiment, the relative movement speed between the droplet discharge heads 50 and the workpiece W (the movement speed at which the stage 5 moves in the X-axis direction) during main scanning is set to 200 mm/sec. The generation timing $f_1$ of the LAT signals is set to 20 kHz in view of the natural frequency characteristics of the droplet discharge heads 50, based on the encoder pulses outputted by the encoder 12 provided to the moving base 22. Therefore, the unit of discharge resolution is 10 μm, as calculated by dividing the relative movement speed by the latch period. Specifically, the discharge timing can be set for each of the nozzles 52 in units of discharge resolution. In other words, droplets D can be arranged in the main scanning direction on the surface of the workpiece W in discharge intervals of 10 μm units.

In the present embodiment, one cycle ($f_1$) of the LAT signals is generated based on 100 encoder pulses. Therefore, it is possible to adjust the generation timing $f_1$ of LAT signals, i.e., to adjust the discharge timing in minimum units of 0.1 μm on the basis of the encoder pulses. If these are replaced by time units, droplets D can be discharged once every 50 μsec, meaning that the discharge timing can be adjusted in units of 0.5 μsec.

During such droplet D discharge control, when jittering (fluctuation) occurs in the encoder pulses outputted by the encoder 12, there is a chance that LAT signals will not be correctly generated according to the intended discharge positions even if the CPU 71 counts a specific number of encoder pulses for defining the discharge timing and generates LAT signals. For example, if the LAT signals are generated early, it is apparent that the discharge timing will be speeded up, and the droplets D will therefore be deposited ahead of the desired intended discharge positions in the main scanning direction. The next drive waveforms may also be applied before the output of previously applied drive waveforms has ended. As described above, the design of drive waveforms is related to the amount of droplets D discharged, the discharge stability, and other such factors, and in cases in which the drive waveforms are applied to the oscillators 59 with insufficient application time, the discharge amount or discharge speed may vary, or unwanted minute droplets known as satellites may be discharged. If the relative movement speed is further increased, the jittering of the encoder pulses has a greater affect on the discharge timing. The effect on the discharge timing is also similarly greater in cases in which the frequency of the drive waveforms is increased so that a plurality of drive waveforms is generated per latch.

In order to avoid discharge defects such as those described above, the CPU 71 as the calculation unit in the droplet discharge device 10 of the present embodiment calculates the elapsed time during main scanning by counting the specific number of encoder pulses that define the discharge timing of the droplets D. The predicted time at which the nozzles 52 reach the intended discharge positions on the workpiece W is calculated based on the arrangement information described above. The elapsed time and the predicted time are then compared, and when the elapsed time is shorter, or when the elapsed time is predicted to be longer and the predicted time has elapsed, control signals are transmitted so that the drive waveforms are applied to the oscillators 59.

In this type of droplet discharge device 10, it is possible to separately use control of discharge timing on the basis of the encoder pulses, and control of discharge timing on the basis of predicted time, i.e., clock signals. Consequently, the effects of jittering in the encoder pulses can be avoided, and droplets D can be discharged onto the workpiece W with positional precision and in stable discharge amounts.

Liquid Material Discharge Control Method

Figure 7:
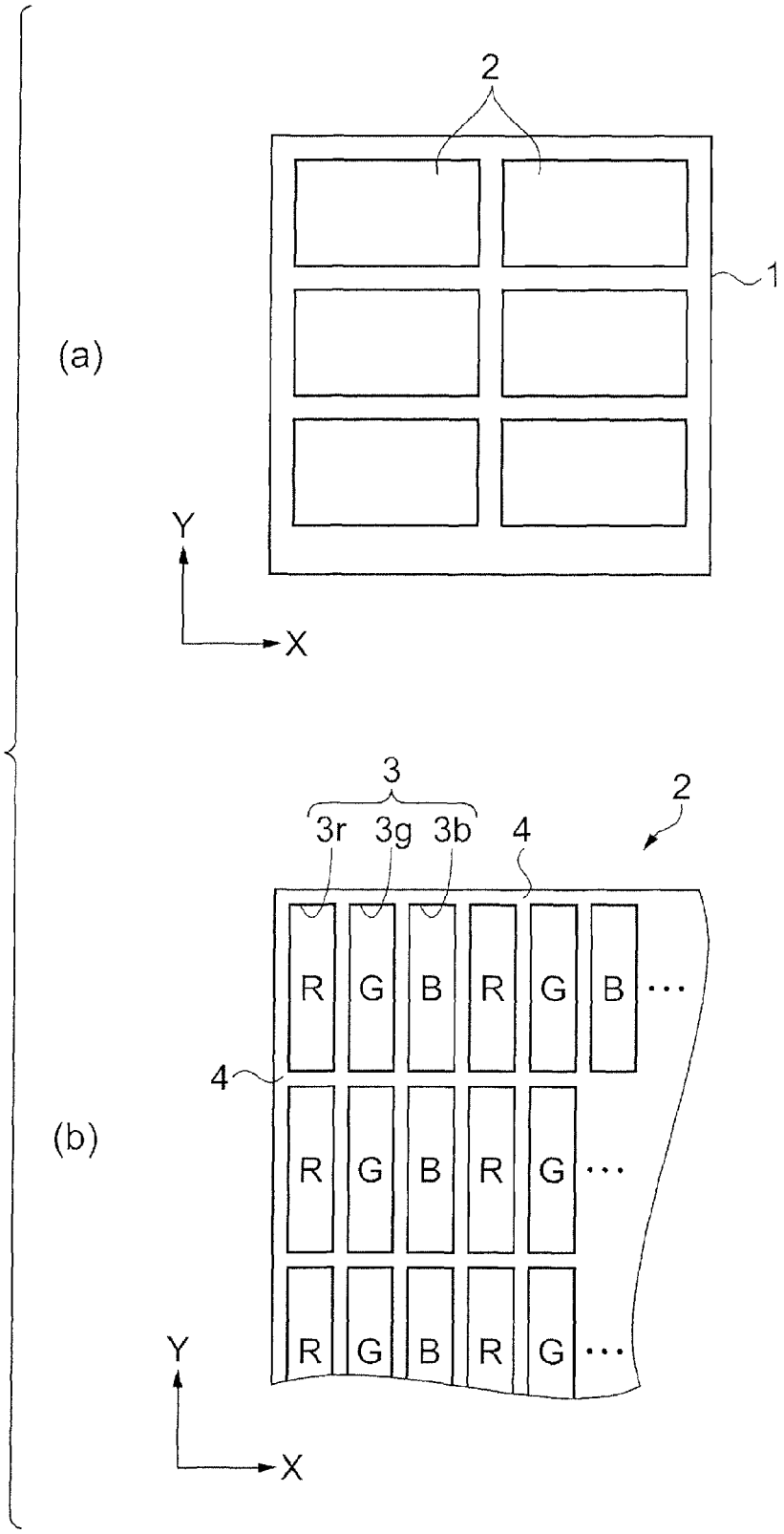
FIGS. 7(*a*) and (*b*) are schematic plan views showing the configuration of color filters.
Figure 8:
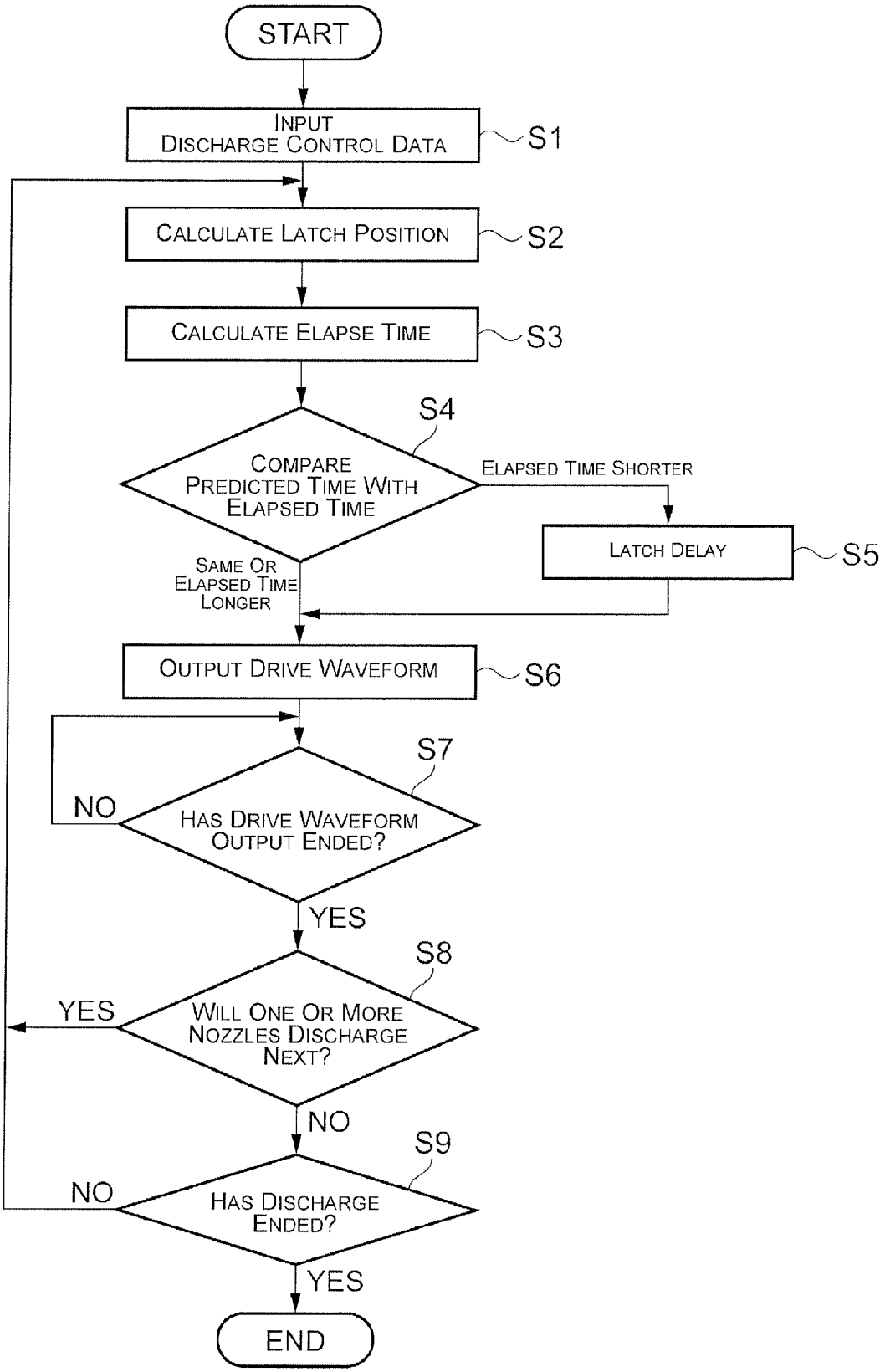
FIG. 8 is a flowchart showing the liquid material discharge control method.
Figure 9:
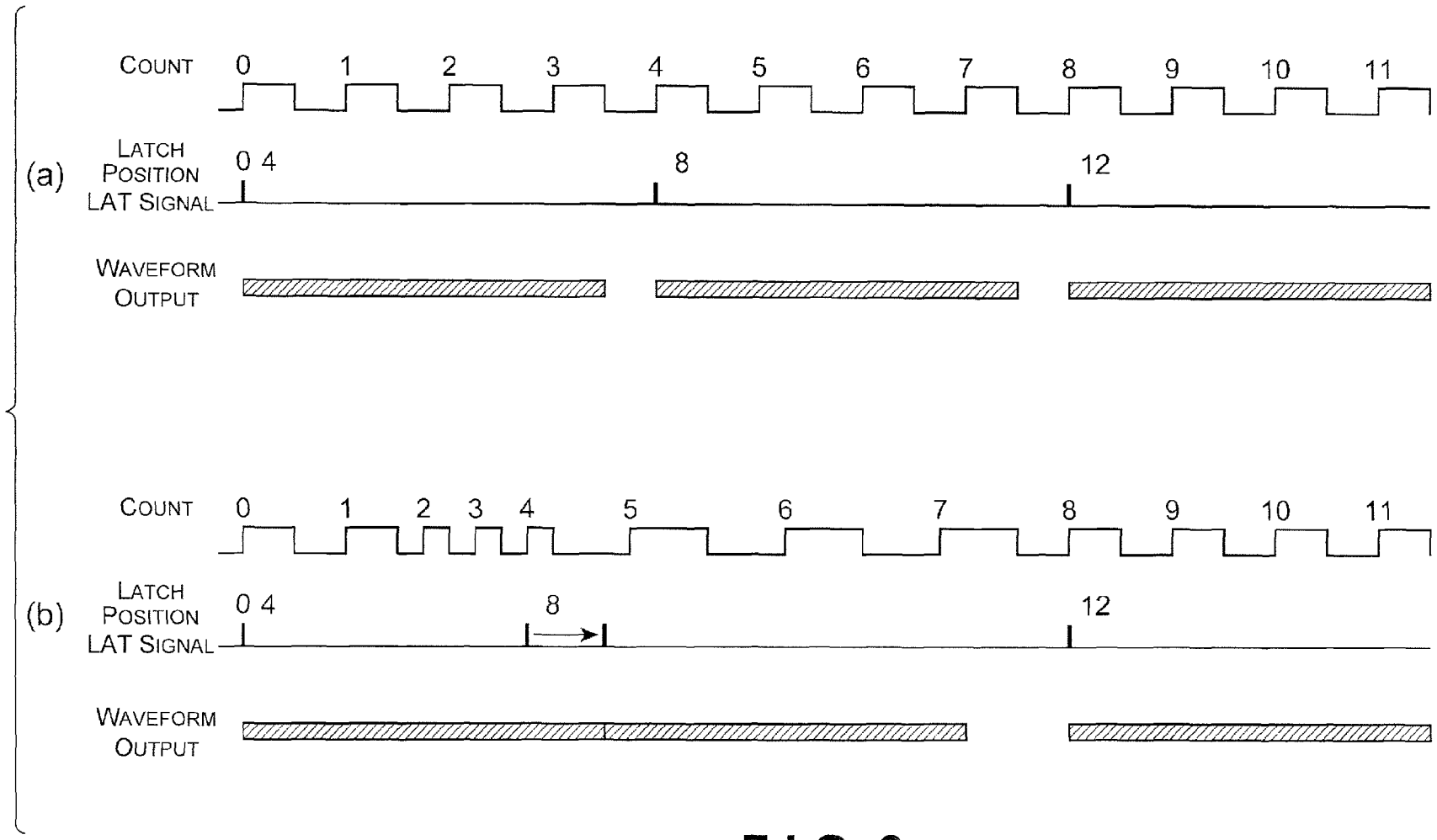
FIGS. 9(*a*) and (*b*) are schematic views showing control signals according to the liquid material discharge control method.
Figure 10:
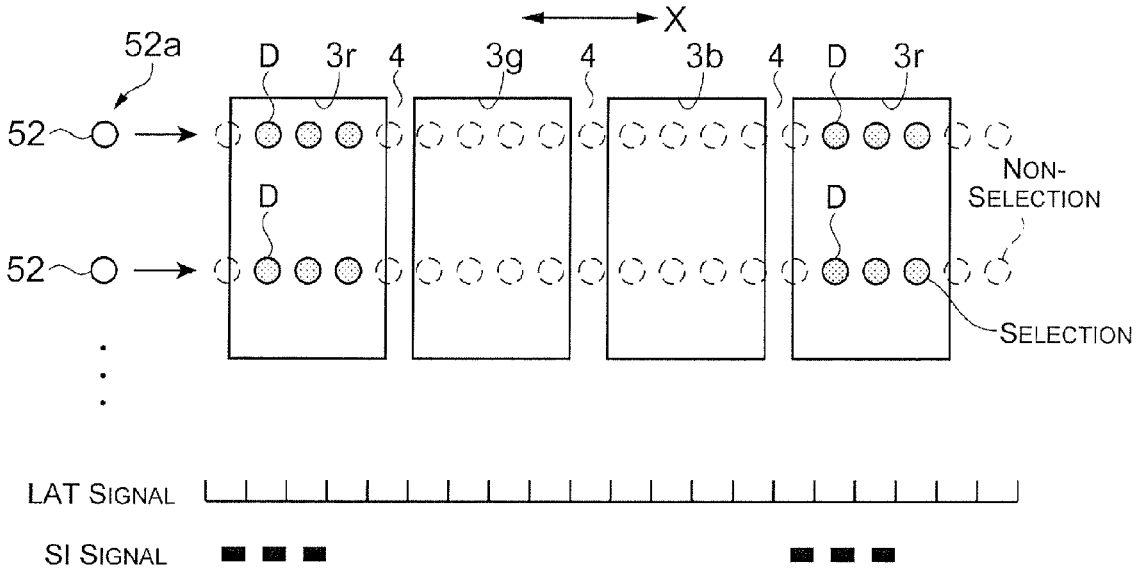
FIG. 10 is a schematic view showing the liquid material discharge control method in a method for manufacturing a color filter.

Next, the liquid material discharge control method of the present embodiment will be described in detail with reference to FIGS. 7 through 10 by using a method for manufacturing a color filter as an example. FIGS. 7(*a*) and (*b*) are schematic plan views showing the configuration of a color filter, FIG. 8 is a flowchart showing the liquid material discharge control method, FIGS. 9(*a*) and (*b*) are schematic diagrams showing the control signals relating to the liquid material discharge control method, and FIG. 10 is a schematic diagram showing the liquid material discharge control method in a method for manufacturing a color filter.

A single color filter 2 or a plurality of filters is placed on the surface of a substrate 1 made of transparent glass or the like. The filter or filters are placed in accordance with the size of the electro-optic device to be used, as shown in FIG. 7(*a*). FIG. 7(*a*) shows an example in which six color filters 2 are placed at specific intervals on one substrate 1, and the filters are arranged in a matrix pattern in the X-axis direction and Y-axis direction.

A color filter 2 has colored layers 3 of three colors, R (red), G (green), and B (blue), as shown in FIG. 7(*b*). The colored layers 3 are partitioned by wall sections 4, with colored layers 3 of the same color aligned in the Y-axis direction (sub-scanning direction), and colored layers 3 of different colors aligned in a repeating pattern in the X-axis direction (main scanning direction). Specifically, the color filters 2 are color filters having a striped pattern.

The method for manufacturing such color filters 2 comprises a discharge step, in which the droplet discharge device 10 is used to fill different droplet discharge heads 50 with liquid materials of three colors containing colored materials, and the liquid materials are discharged as droplets D onto film formation areas 3*r*, 3*g*, 3*b* partitioned by the wall sections 4; and a film formation step in which the discharged liquid materials are dried, thereby forming colored layers 3 of three colors. In the discharge step, the substrate 1 as the workpiece is placed on the stage 5 so that the direction of the stripes in the colored layers 3 coincides with the Y-axis direction, the droplet discharge heads 50 and the substrate 1 are arranged facing each other, and main scanning is performed in which the stage 5 is moved in relative fashion in the X-axis direction. The main scanning is performed multiple times and the liquid materials of three colors are discharged as droplets D so that the necessary amounts of the liquid materials are provided to each of the film formation areas 3*r*, 3*g*, 3*b*.

The liquid material discharge control method of the present embodiment comprises a step for inputting discharge control data indicating the manner in which droplets D are to be discharged into each of the film formation areas 3*r*, 3*g*, 3*b* during main scanning (step S1), a step for calculating latch positions on the basis of the discharge control data (step S2), and a calculation step for counting the outputs of encoder pulses and calculating a first elapsed time of relative movement (step S3), as shown in FIG. 8.

Also included are a comparison step (step S4) for comparing the first elapsed time with a first predicted time for which the nozzles 52 are predicted to reach specific intended discharge positions on the substrate 1 (step S4), and a step for delaying the latch so that the droplets D are discharged when the first predicted time has elapsed in cases in which the first elapsed time is shorter than the first predicted time (step S5).

Also included are a step for outputting the selected drive waveforms (step S6), and a step for determining whether or not drive waveform output has ended (step S7).

Further included are a step for referencing the discharge control data to determine whether or not one or more nozzles will discharge next (step S8), and a step for determining whether or not the discharge of droplets D during main scanning has ended (step S9).

Step S1 in FIG. 8 is a discharge control data input step. In step S1, discharge control data is inputted for each of the main scans. The data includes the relative intended discharge positions of the plurality of nozzles 52 in relation to the film formation areas 3*r*, 3*g*, 3*b*; the selection of nozzles 52 for discharging droplets D; the number of discharges of droplets D; and discharge timing information for the process of discharging the droplets D. Specifically, discharge control data contained in the RAM 43 of the control unit 40 is transmitted to the head driver 48 with each main scanning and is stored in the memory 73. The process then advances to step S2.

Step S2 in FIG. 8 is a latch position calculation step. In step S2, the CPU 71 calculates the latch positions on the basis of the discharge control data stored in the memory 73. Specifically, the reference position of relative movement at a specific movement speed is set to "0," and the latch position that will cause the next LAT signal to be generated is converted to the number of encoder pulse outputs and calculated, as shown in FIG. 9(*a*). As described above, in the droplet discharge device 10 of the present embodiment, one LAT signal cycle is based on 100 encoder pulses, but only four are shown in FIGS. 9(*a*) and (*b*) in order to simplify the diagrams. If the encoder pulses are counted normally, a LAT signal is generated for every count of a specific number of encoder pulses, during which the output of the time drive waveform is ended. The process then advances to step S3.

Step S3 in FIG. 8 is an elapsed time calculation step. In step S3, the encoder pulses generated periodically during main scanning are counted and the first elapsed time is calculated. Specifically, in cases in which, e.g., a red liquid material is discharged onto the R (red) film formation areas 3*r* aligned in the main scanning direction, droplets D are discharged when the relative positions of the nozzles 52 are within the film formation areas 3*r*, as shown in FIG. 10. In other words, droplets D are not discharged when the relative positions of the nozzles 52 are either on the wall sections 4 or within the film formation areas 3*g*, 3*b* of the other colors. Specifically, LAT signals are generated in specific cycles by the encoder pulses, and the discharge of the nozzles 52 is controlled by the SI signals (nozzle data signals) between a selection for discharging droplets D, and a non-selection for not discharging droplets D in accordance with the relative positions of the film formation areas 3*r* and the wall sections 4. Based on the LAT signal during non-selection before the first droplets D are discharged onto the film formation areas 3*r*, the CPU 71 then counts the number of encoder pulse outputs until the next LAT signal, and calculates the time when four (a specific number) counts have taken place as the first elapsed time. The process then advances to step S4.

Step S4 in FIG. 8 is a comparison step. In step S4, the CPU 71 as a comparison unit compares the first elapsed time with the first predicted time at which the nozzles 52 reach the intended discharge positions where the droplets D are to be discharged. Specifically, the first predicted time is integrated based on the LAT signal during non-selection before the first droplets D are discharged onto a film formation area 3*r*. Therefore, the time is clearly 50 μsec because the LAT signal cycle is set at 20 kHz. By comparing the actually calculated first elapsed time with the first predicted time, it is possible to determine whether or not encoder pulses have been counted within a specific cycle. If the first elapsed time is shorter than the first predicted time, the process advances to step S5. The process advances to step S6 in cases in which the first predicted time and the first elapsed time coincide, and also in cases in which the first elapsed time is longer than the first predicted time.

Step S5 in FIG. 8 is a latch delay step. In step S5, if the first elapsed time is shorter than the first predicted time, discharge is controlled so that drive waveforms are applied to the oscillators 59 of the selected nozzles 52 when the first predicted time has elapsed. For example, when jittering occurs in the encoder pulses, four (a specific number) encoder pulses are sometimes counted early, as shown in FIG. 9(*b*). A LAT signal is generated in this state and a drive waveform is outputted based on this LAT signal, whereupon the next drive waveform is outputted before the output of the previously generated drive waveform ends. Consequently, at the very least, when the output of the previously generated drive waveform has ended, discharge timing is delayed so that the next drive waveform is outputted. Specifically, the LAT signal is delayed substantially.

The phrase "a state in which the first elapsed time and the first predicted time actually coincide" refers to a case in which it is determined that a match is established as long as the difference between the first elapsed time and the first predicted time is within a range that is less than the minimum unit time (0.5 μsec) of the encoder pulses, and is equal to or greater than the minimum unit time (0.05 μsec) of the clock signals. In other words, when the first elapsed time is shorter than the first predicted time by an interval that is equal to or greater than the minimum unit time of the encoder pulses, the drive waveform is applied when the first predicted time has elapsed.

Step S6 in FIG. 8 is a drive waveform output step. In step S6, periodically generated drive waveforms are selected and applied to the oscillators 59 on the basis of the LAT signals and the SI signals. The first droplets D are thereby discharged from the selected nozzles 52 and deposited onto the film formation area 3*r*, as shown in FIG. 10. The process then advances to step S7.

Step S7 in FIG. 8 is a step for determining whether or not the drive waveform output has ended. In step S7, the CPU 71 determines whether or not the drive waveform output has ended. If it has ended, the process advances to step S8. If it has not ended, the CPU waits until drive waveform output has ended.

Step S8 in FIG. 8 is a step for determining whether or not there will be another discharge. In step S8, the CPU 71 refers to the discharge control data to determine whether there will be another discharge from one or more nozzles. If there will be a discharge from one or more nozzles, the process returns to step S2. If not, the process advances to step S9. In this case, since three droplets D are discharged in the main scanning direction onto the film formation area 3*r* as shown in FIG. 10, the process continues to steps S2 through S8, which are repeated twice. The nozzles 52 then move in relative fashion to the areas of non-selection, and the process therefore advances to step S9.

Step S9 in FIG. 8 is a step for determining whether or not the discharge of droplets D during main scanning has ended. In this case, the nozzles 52 move in relative fashion to the next film formation area 3*r* in step S9, as shown in FIG. 10. Consequently, steps S2 through S8 are repeated because discharge is performed again. One main scan is ended as long as the discharge of droplets D has ended. Thus, it is preferable to perform a resynchronization step for synchronizing the next discharge timing with the encoder pulse within an arbitrary time period in which droplets D are not discharged from all of the nozzles 52 during one main scan. The specific number of encoder pulses that define the discharge timing does not substantially change even if the relative movement speed of the stage 5 during main scanning is changed. Consequently, it is possible to avoid instances in which the discharge timing information dramatically increases in accordance with the elapsed time in comparison with cases in which the discharge timing is controlled based on the predicted time at which the nozzles 52 reach the intended discharge positions. Specifically, discharge can be controlled more efficiently.

It is believed that in cases in which the latch delay step in step S5 is applied, the next discharge timing may substantially deviate from the original intended discharge position if the next discharge arrives after the time period in which droplets D are not discharged from all of the nozzles 52. It is therefore preferable, in a resynchronization step such as step S9, to correct and synchronize the number of encoder pulse outputs counted in the time period in which droplets D are not discharged from all of the nozzles 52 so that the number of outputs coincides with the time period until the next intended discharge position. It is thereby possible to deposit droplets D with high discharge positional precision in the main scanning direction, even in cases in which droplets D are discharged intermittently.

In the liquid material discharge control method described above, control of the timing whereby droplets D are discharged can be separated into control by encoder pulses and control by clock signals, and this type of control is performed for every main scan. The control may also be performed for every film formation area 3*r*, 3*g*, 3*b* onto which droplets D are deposited. Specifically, it is possible to avoid at least instances in which discharge timing is early and droplets D are discharged onto the film formation areas 3*r*, 3*g*, 3*b* as a result of jittering in the encoder pulses. Since drive waveforms are applied at appropriate application times, droplets can be discharged in stable amounts onto the film formation areas 3*r*, 3*g*, 3*b*.

Various modifications can be made in addition to the embodiments described above. Modifications are presented and described hereinbelow.

Modification 1

In the liquid material discharge control method described above, the first elapsed time was calculated in the comparison step of step S4 by counting a specific number of encoder pulses, but in cases in which the first elapsed time was longer than the first predicted time, drive waveforms were applied in this state on the basis of LAT signals. In this case, it is of course not possible to go back to the first predicted time and to discharge the droplets D. In view of this, the following method of comparing the elapsed time with the predicted time can be used as a method for avoiding instances in which the generation timing of LAT signals is slowed by jittering in the encoder pulses.

Specifically, in the step for calculating the elapsed time in the course of step S3, outputs of encoder pulses obtained by subtracting a standard number from a specific number are counted to calculate a second elapsed time. This method also involves calculating a second predicted time obtained by subtracting a time that is equivalent to the standard number of encoder pulse outputs from the first predicted time, and comparing the second elapsed time and the second predicted time. For example, three encoder pulse outputs, which are one subtracted from four, are counted and set as the second elapsed time, and a time that is equivalent to three encoder pulse outputs is set as the second predicted time. Thus, by comparing the second elapsed time and the second predicted time, it is possible, as a result of these calculations, to predict in advance whether the first elapsed time is shorter than, longer than, or equal to the first predicted time. When it is predicted that the first elapsed time will be longer, the next drive waveform can be outputted when the first predicted time has elapsed or when the output of the previous drive waveform has ended.

Modification 2

Figure 11:
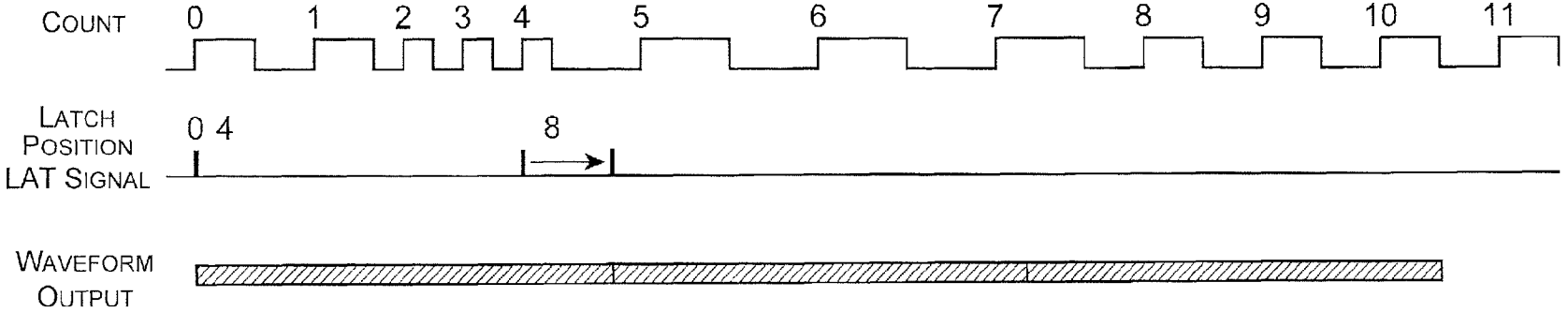
FIG. 11 is a schematic view showing control signals in a modified discharge control method.

FIG. 11 is a schematic view showing the control signals in a modified discharge control method. In the liquid material discharge control method described above, the process returns to step S2 and the latch position is calculated in cases in which a determination is made in step S8 as to whether one or more nozzles will discharge next and it is found that one or more nozzles will discharge. The discharge control data is set so that three droplets D are discharged onto one film formation area 3*r*, as shown in FIG. 10. Therefore, the configuration may be designed so that the discharge control data is referenced, and in cases in which droplets D are then discharged, the process returns to step S6, and three drive waveforms are outputted continuously as shown in FIG. 11 and applied to the oscillators 59. In other words, the first elapsed time and the first predicted time can be compared for the first discharge of continuously discharged droplets D. Thus, discharge control can be further simplified.

Modification 3

In Modification 2 described above, the comparison between the first elapsed time and the first predicted time is not limited to the first output of continuously discharged droplets D. For example, the first discharged may be performed by counting the specific number of encoder pulses that define the discharge timing. The first elapsed time and the first predicted time may also be compared at the second discharge.

The arrangement of the film formation areas 3*r*, 3*g*, 3*b* partitioned by wall sections 4 in the color filters 2 do not need to be set using units of discharge resolution (10 μm in the present embodiment). For example, the arrangement of the colored layers 3 may define the arrangement of pixels in the electro-optical apparatus. It is apparent that in cases in which the pixels are set using inches as such units, the same applies to the arrangement of the colored layers 3. Therefore, when droplets D are continuously discharged onto the film formation areas 3*r*, 3*g*, 3*b*, in order to reliably ensure the initial discharge positions, the first droplets D are discharged based on encoder pulses generated in synchronization with main scanning, and the first elapsed time and first predicted time are compared at the second discharge. Furthermore, in cases in which droplets D continue to be discharged, drive waveforms are preferably applied selectively to the drive unit (oscillators 59) on the basis of the first predicted time.

According to this method, it is possible to reliably apply drive waveforms to the drive unit (oscillators 59) and to continuously discharge droplets D in stable discharge amounts while ensuring initial discharge positions in each of the film formation areas 3*r*, 3*g*, 3*b*.

Modification 4

Figure 12:
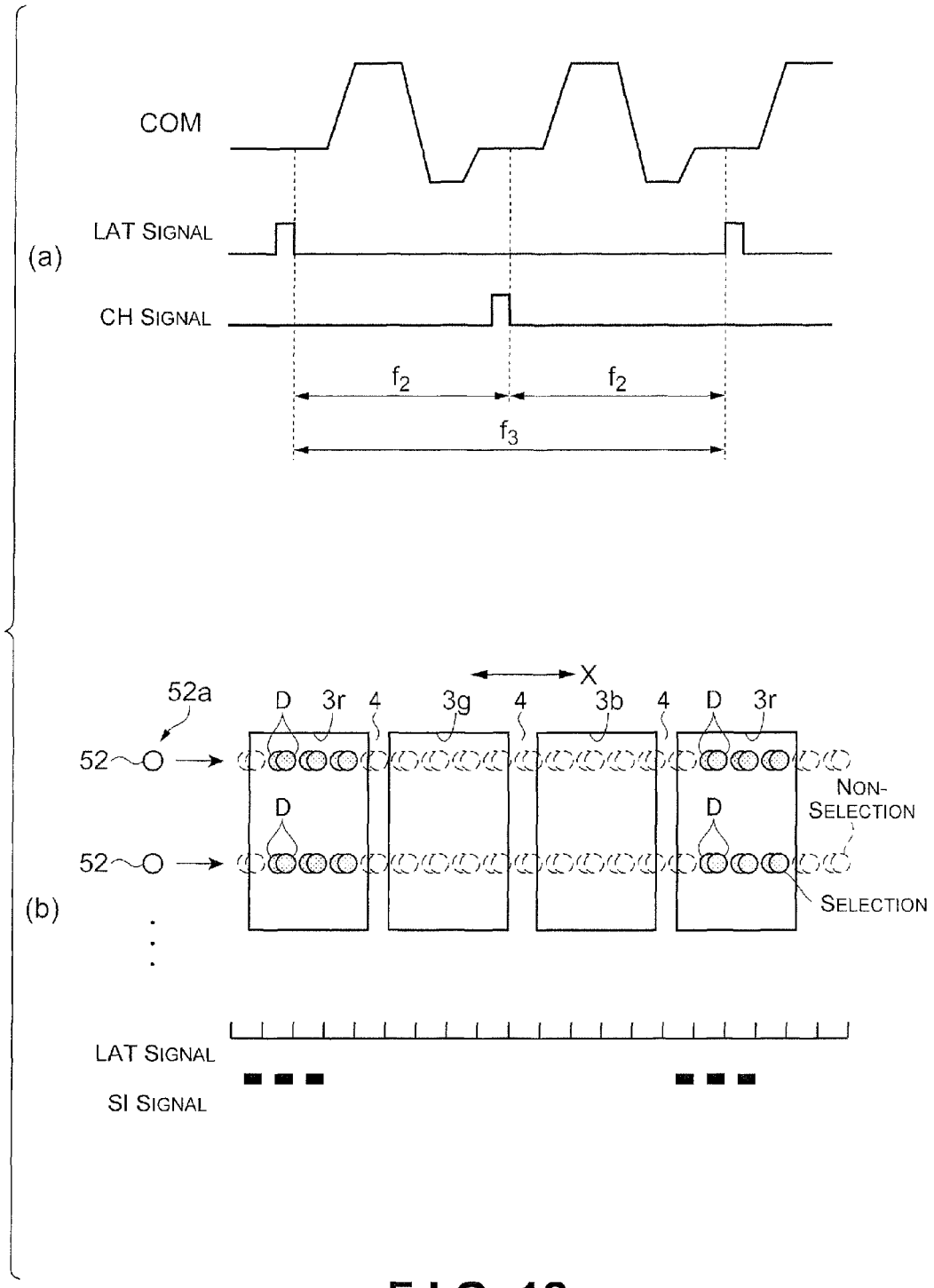
FIG. 12(*a*) is a diagram showing a modified liquid material discharge control method and demonstrating the relationship between drive waveforms and control signals, and (*b*) is a schematic plan view showing the manner in which droplets are discharged in a modified method for manufacturing a color filter.

FIGS. 12(*a*) and (*b*) are schematic diagrams showing a modified liquid material discharge control method. FIG. 12(*a*) is a diagram showing the relationship between drive waveforms and control signals, and FIG. 12(*b*) is a schematic plan view showing the manner in which droplets are discharged in a method for manufacturing a color filter.

In the liquid material discharge control method described above, the number of drive waveforms generated during one cycle of LAT signals is not limited to one. For example, two drive waveforms (COM) may be generated during one cycle $f_3$ of LAT signals, as shown in FIG. 12(*a*). The control signals may be configured so that either of the two drive waveforms is selected by the LAT signals and the CH signals. Thus, the drive waveform generation cycle $f_2$ can be set shorter and higher frequency driving is possible in comparison with the configuration of control signals in the discharge control shown in FIG. 6. For example, six droplets D can be continuously discharged from the nozzles 52 in the main scanning direction (X-axis direction) onto the film formation areas 3*r*, as shown in FIG. 12(*b*). The necessary amount of liquid material can thereby be provided to the corresponding film formation areas in a shorter amount of time. In other words, drive waveforms can be reliably applied to the drive unit (oscillators 59) even if the discharge of liquid material is sped up, and it is therefore possible to avoid the effects of jittering in the encoder pulses and to discharge the droplets D in stable discharge amounts.

With adjacent nozzles 52 associated with a film formation area 3*r*, if the drive waveform selected by the LAT signal is applied to one nozzle 52 and the drive waveform selected by the CH signal is applied to the other nozzle 52, the drive waveforms can be applied to the adjacent nozzles 52 at temporally separated discharge timings. Specifically, crosstalk between adjacent nozzles 52 can be reduced, and the liquid material can be discharged in a more stable manner.

Modification 5

The method for manufacturing a device to which the liquid material discharge control method described above can be applied is not limited to a method for manufacturing a color filter. For example, the liquid material discharge control method can also be applied to a method for manufacturing a functional layer containing an organic EL (electroluminescent) light-emitting layer, a method for manufacturing an orientation film for controlling the oriented direction of liquid crystal molecules, a method for manufacturing electrodes in switching elements or metal and other wirings, or any other method that uses droplet discharge (inkjet method).

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid material discharge control method comprising:

calculating a first elapsed time in a relative movement between a plurality of nozzles and a workpiece by counting a first prescribed number of outputs of timing signals that define discharge timing for discharging a liquid material from the nozzles onto the workpiece, the timing signals being encoder pulse signals generated by an encoder periodically during a scan in which the nozzles and the workpiece are moved relative to each other, the workpiece having a first film formation area and a second film formation area that are partitioned with a wall section on the workpiece and aligned in a main scanning direction, the calculating of the first elapsed time being performed for discharging the liquid into the first film formation area;

comparing the first elapsed time with a first predicted time at which the nozzles are predicted to reach intended discharge positions for discharging the liquid into the first film formation area;

discharging the liquid material from the nozzles into the first film formation area upon the first predicted time having elapsed when the first elapsed time is shorter than the first predicted time;

calculating a second elapsed time by counting a second prescribed number of outputs of the timing signals with the second prescribed number being obtained by subtracting a predetermined number of outputs of the timing signals from the first prescribed number for discharging the liquid into the first film formation area, the predetermined number being equal to or more than one;

comparing the second elapsed time with a second predicted time with the second predicted time being obtained by subtracting a predetermined time corresponding to the predetermined number from the first predicted time; and discharging the liquid material from the nozzles onto the workpiece upon the first predicted time having elapsed in response to predicting that the first elapsed time is longer than the first predicted time; and resynchronizing a subsequent discharge timing for commencing to discharge the liquid into the second film formation area by adjusting the subsequent discharge timing so as to synchronize with the timing signals during a prescribed time period in which no droplets are discharged from the nozzles and while the nozzles moves in a non-discharging area from the first film formation area to the second film formation area in the main scanning direction relative to the workpiece after ending discharging the liquid into the first film formation area, the non-discharging area including the wall section and being arranged between the first film formation area and the second file formation area in the main scanning direction.

2. The liquid material discharge control method according to claim 1, wherein the discharging of the liquid material includes applying at least one periodically generated drive waveform to a drive unit of each of the nozzles to discharge the liquid material as droplets from the nozzles, and selectively applying a subsequently generated drive waveform to the drive unit after output of a previously generated drive waveform has ended when the first elapsed time is shorter than the first predicted time or when the second elapsed time is shorter than the second predicted time.

3. The liquid material discharge control method according to claim 1, wherein the resynchronizing of the subsequent discharge timing includes correcting a number of outputs of the timing signals counted in the prescribed time period so as to coincide with a time period until a next intended discharge position.

4. The liquid material discharge control method according to claim 1, wherein the calculating of the first elapsed time, the comparing of the first elapsed time with the first predicted time, the discharging of the liquid material and the resynchronizing of the subsequent discharge timing are performed by dividing the relative movement during the scan into forward movement and reverse movement.

5. The liquid material discharge control method according to claim 4, wherein the workpiece has a plurality of film formation areas that includes the first film formation area and the second film formation area, are arrayed in the scanning direction, and are partitioned with respect with each other, and the calculating of the first elapsed time, the comparing of the first elapsed time with the first predicted time, and the discharging of the liquid material and the resynchronizing of the subsequent discharge timing are performed during discharging the liquid into each film formation area, the resynchronizing is performed while no droplets are discharged from the nozzles and the nozzles moves between the film formation areas in the main scanning direction relative to the workpiece.

6. The liquid material discharge control method according to claim 5, wherein the discharging of the liquid material includes discharging a plurality of droplets from the nozzles onto each film formation area on the workpiece during the scan, the calculating of the first elapsed time, the comparing of the first elapsed time with the first predicted time and the discharging of the liquid material are performed at an initial discharge of the droplets on each film formation area, and at least one periodically generated drive waveform is applied to a drive unit of each of the nozzles to discharge the droplets from the nozzles.

7. The liquid material discharge control method according to claim 5, wherein the discharging of the liquid material includes discharging a plurality of droplets from the nozzles onto each film formation area on the workpiece during the scan, and discharging first droplets onto each of the film formation areas by counting a prescribed number of outputs of the timing signals that define the discharge timing, the calculating of the first elapsed time, the comparing of the first elapsed time with the first predicted time and the discharging of the liquid material are performed when discharging second droplets onto each film formation area, and at least one periodically generated drive waveform is applied to a drive unit of each of the nozzles when the droplets continue to be discharged.

* * * * *